US005232233A

United States Patent [19]

Jedora

[11] Patent Number: 5,232,233

[45] Date of Patent: Aug. 3, 1993

[54] PORTABLE AUXILIARY WHEEL

[76] Inventor: John Jedora, 724 Richelieu Street, Timmins, Ontario, Canada, P4N 5G6

[21] Appl. No.: 700,714

[22] Filed: May 17, 1991

[51] Int. Cl.[5] ..... B62B 1/14

[52] U.S. Cl. ..... 280/47.331; 414/458; 280/79.7; 280/47.131; 301/111

[58] Field of Search ..... 301/1, 5 R, 111, 114; 414/444, 458; 280/47.131, 47.331, 79.7; 410/2, 44, 45

[56] References Cited

U.S. PATENT DOCUMENTS 3,586,345 6/1971 Nall ..... 280/47.331 X 3,717,357 2/1973 Schaefer ..... 280/47.131 X 5,018,930 5/1991 Hardin ..... 414/458

5,048,850 9/1991 McDonald ..... 280/79.7 X

FOREIGN PATENT DOCUMENTS 8502401 4/1987 Netherlands ..... 280/79.7

*Primary Examiner*—Russell D. Stormer

[57] ABSTRACT

A portable wheel assembly is provided with a parallel-type clamping system for attachment to objects, such as the transom of a car-top boat. An improved clamping effect is obtained using "U"-shaped tubing that embraces the wheel.

20 Claims, 6 Drawing Sheets

PORTABLE AUXILIARY WHEEL

FIELD OF INVENTION

This invention relates to an attachable wheel assembly for providing support to a variety of loads. More particularly, with the basic wheel assembly combined in pairs or with added elements, a rolling support may be provided for boats, boat motors and the like.

BACKGROUND TO THE INVENTION

Many articles, such as car-top boats and outboard boat motors must be transported by hand to be put into use. This is particularly difficult where these articles are heavy, or only a single person is available to move them.

Due to the portable character of such articles, it would be desirable to provide attachable wheels that are light, compact and readily portable themselves. Such wheels should attach easily to the article to be transported, remain reliably fastened in place during use, and be readily detachable for storage thereafter.

As a further objective for such a portable wheel assembly, the unit itself should be made from low-cost components that may be readily fabricated. Simplicity of construction is a key consideration in minimizing costs for such a device.

It is with these objectives in mind that the following invention has been conceived. The invention will be first summarized in terms of its most general form and its further supplementary features. The specific applications of the invention will then be detailed through the description of specific embodiments, with reference to drawings. These embodiments are intended to demonstrate the principle of the invention, and the manner of its implementation. They are exemplary only. The invention will then be further described, and defined, in each of the individual claims which conclude this Specification.

SUMMARY OF THE INVENTION

The essential component of the invention is a wheel assembly comprising a wheel mounted on an axle, and an attachment means, preferably based on a principle akin to a class of parallel clamp, for coupling the wheel to an article to be supported. A parallel clamp is able to develop a compressive force between the free ends of two long longitudinal members that are separated by two adjustable linkages spaced a distance from the free ends. By adjustment of the linkages the leverage effects of a first class lever with an adjustable fulcrum can be obtained to apply to compressive force.

According to the preferred embodiment, the attachment means comprises a pair of "U"-shaped clamping members, each comprising a pair of free-standing arms located at one end of the member, the arms being joined by a cross-member at the other end to for the "U". The first of the "U"-shaped clamping members carries at least one wheel mounted on an axle that extends between the two free arms of such first member. Optionally, two or more wheels may be carried on the axle to provide lateral stability. The second "U"-shaped clamping member is mounted in a substantially aligned and parallel, but adjustable, relationship to said first "U"-shaped member, with the free arms of each "U"-shaped clamping member being opposed by the free arms of the other "U"-shaped member. This mounting is effected by two pairs of threaded connectors passing between the respective arms of the "U"-shaped clamping members in a spaced array. These connectors are displaced or removed from the cross-member by a distance which will allow insertion of an article-to-be-clamped between the "U"-shaped clamping members. Within each pair of connectors, one connector, constituting the outer connector, is located at a position substantially displaced or removed from the cross member, preferably near the free end of the arms; and the other is located intermediate or between the cross-member and the outer connector, constituting the intermediate connector.

The outer ends of the free arms of each of the "U"-shaped clamping members together with the cross member, which serves as a clamping end, define a plane, the perpendicular to which is perpendicular to the direction of orientation of the axle. With this configuration, displacement of the clamping members to engage on article occurs in a direction which is perpendicular to the alignment of the axle.

At least one outer end of each of the intermediate connectors carries an adjustable arm-engaging outer fastener threaded onto such connector. The other outer end of each of such connectors is provided with arm-engaging outer stop means whereby the respective "U"-shaped members may be drawn together by advancing the outer fastener on the intermediate connector.

The outer connector, in a complementary fashion, carries an arm-engaging inner stop means and an adjustable, arm-engaging inner fastener, both mounted on the outer connector at positions located between the arms of the "U"-shaped clamping members. By adjustment of the inner fastener, the arms of the respective "U"-shaped clamping members can be forced apart.

By simultaneously drawing the clamping members together by tightening the intermediate connector and expanding the outer connector adjusted to a clamping action may be applied on an object placed between the cross-members, such action being applied in the manner of a parallel clamp.

In many parallel clamps the intermediate and outer connectors are fully threaded into the clamping bars. In such cases the threaded portions of the bars qualify as adjustable fasteners, albeit that the connectors, once adjusted are fixed within each arm. While this arrangement is permissible, it is sufficient for the present invention that the connectors be adjustable only to the extent as described.

The preferred embodiment of the invention effectively relies on the clamping action of two parallel clamps, corresponding to the four arm portions of the "U"-shaped clamping members. The cross-member serves to align the ends of these arms in each pair, and provides a line-contact for the clamping action. The presence of the wheel between the free arms of each "U"-shaped clamping member helps transfer loads to the wheel axle symmetrically.

Preferably, the "U"-shaped members are formed from metal tubing, and the connectors are threaded bolts with heads at one end that serve as the outer stop means, and threaded nuts that serve as the inner stop means, and as adjustable fasteners. Tubing formed of thick walled polymeric plastic material may also be used.

Optionally, the arms of the tubing may be reinforced with wooden cores.

By a further feature of the invention, the aforesaid wheel assemblies may be mounted either singly or in pairs along the lower edge of a transverse panel, the transverse panel having an upright portion with a terminal end to which may be attached various loads, such as an outboard motor.

In a similar manner the aforesaid wheel assembly may be mounted in pairs to the stern panel or transom of a car-top boat for easy transportation of the boat on land to the quayside.

The foregoing summarizes the principal features of the invention. These and further features will be better understood by reference to the description of the preferred embodiments and drawings which will now follow.

DESCRIPTION OF THE PREFERRED EMBODIMENTS

Figure 1:
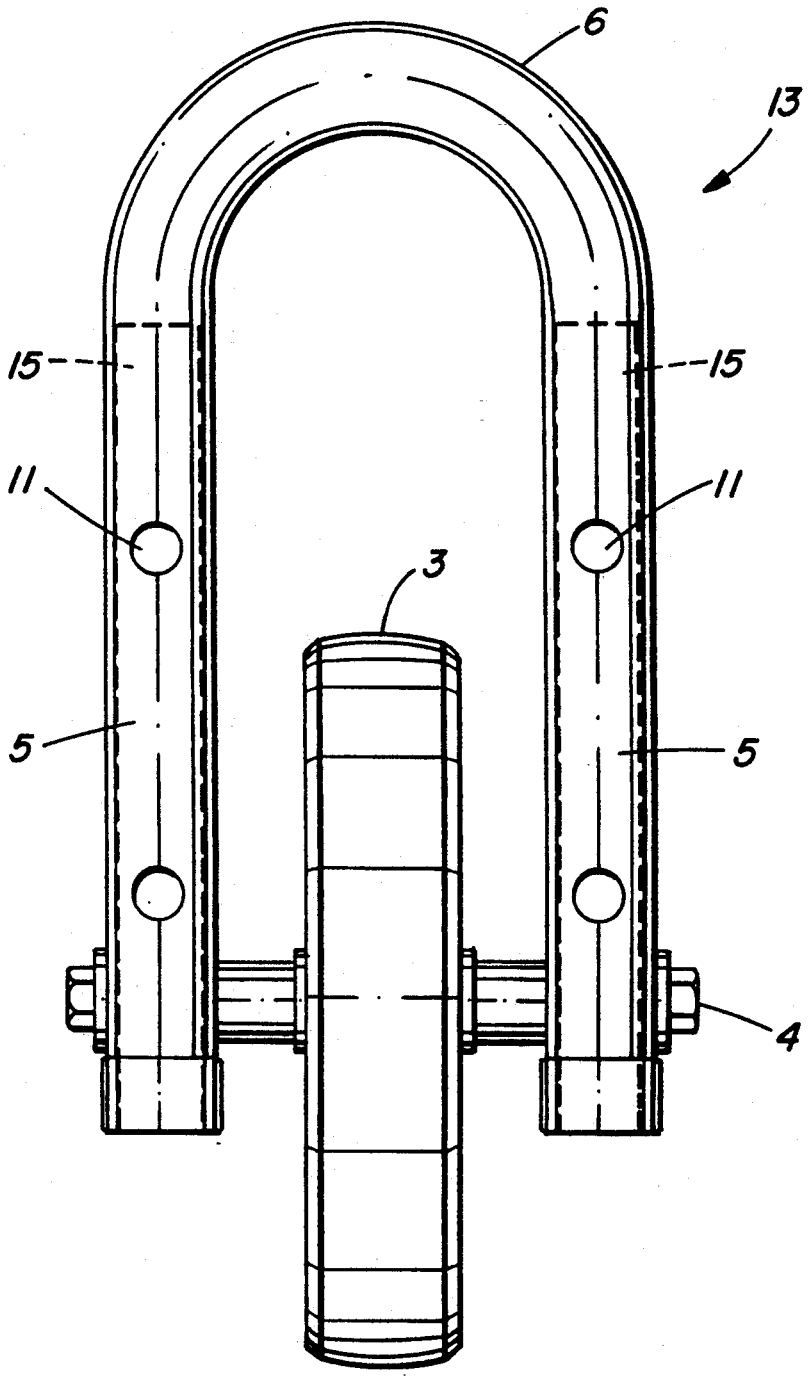
FIG. 1 is a front view of the wheel assembly, viewed perpendicularly to the wheel axle.

In FIG. 1 a wheel assembly 13 is shown in front view, wherein the first of a pair of "U"-shaped clamping members in the form of bent tubes 1, 2 is shown with a wheel 3 mounted on an axle 4 being carried between the arms 5 of the tube 1. The upper bridging portion 6 between the arms 5 forms a cross-member 6 therebetween that holds the arms 5 in parallel orientation.

Figure 2:
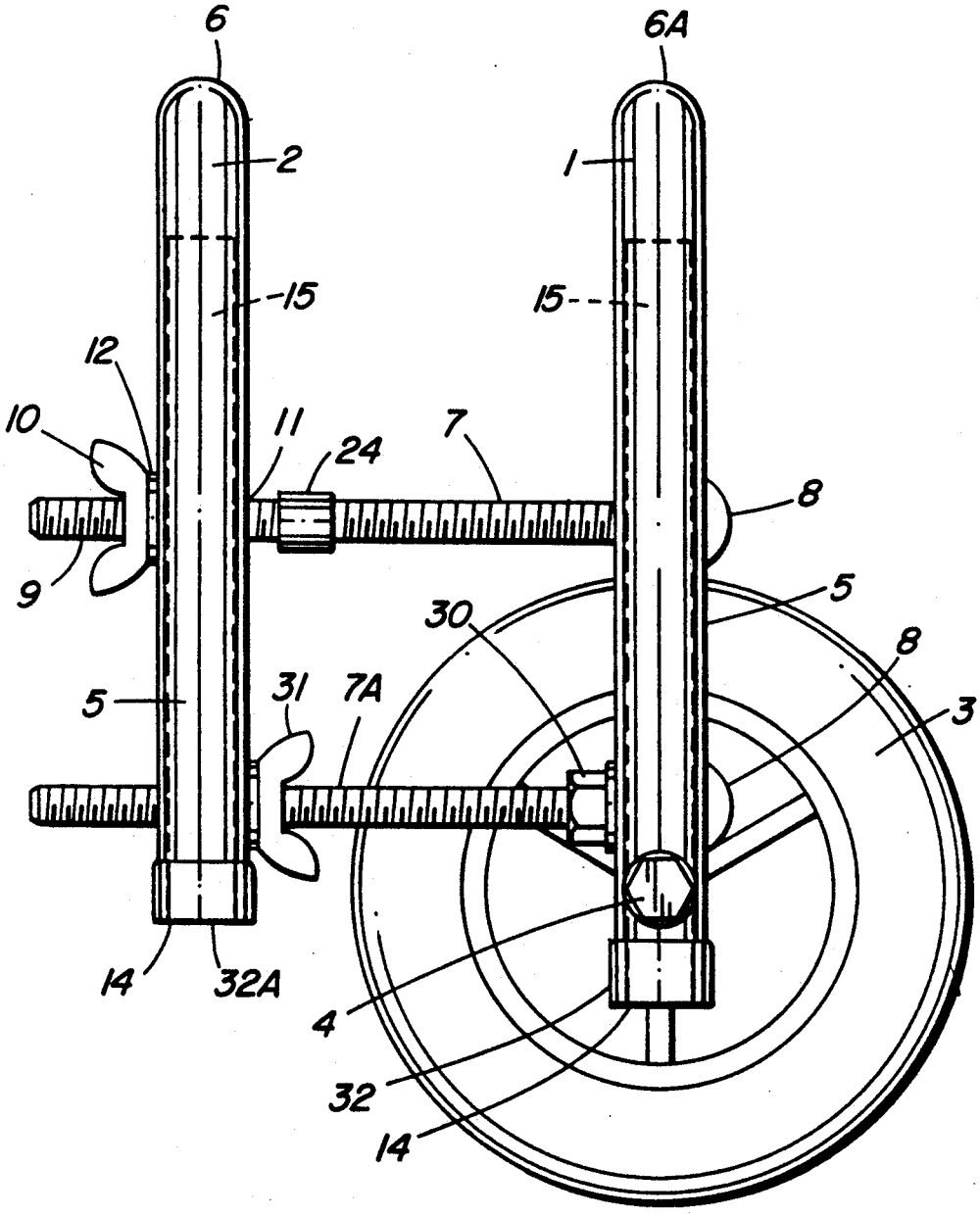
FIG. 2 is a side view of the wheel assembly.

In FIG. 2 the first two of four threaded connectors 7 passing in pairs between the arms 5 of the respective "U"-shaped tubes 1, 2 are shown. The clamping tubes 1, 2 are shown as being substantially separated for clarity of the drawing. These connectors 7, which serve as the intermediate connectors 7, are mounted above the upper boundary of the wheel 3 to provide clearance between the wheel and object to be carried. The connectors 7 are shown as bolts having heads 8 at one end and threaded shaft portions 9 at the other end carrying wing nuts 10. These bolt heads 8 and wing nuts 10 serving as outer stop means and adjustable fasteners, engage the arms 5 by contacting them around the perimeter of the holes 11 in the arms 5 through which the bolts 7 pass.

While wing nuts 10 are shown, the holes 11 in the arms 5 remote from the bolt heads 8 may alternately be threaded to provide fastening means into which the bolts 7 may be fully threadably engaged. In such a case the bolt heads may optionally be provided with thumb plates (not shown) to facilitate manual rotation of the bolts.

The second set of the four threaded connectors, which serve as outer connectors *7a*, are also shown as bolts having heads 8 and threaded shaft portions 9. However, a nut 30 located between the clamping members 1, 2 serves as an inner stop member; and a wing nut 31, also similarly located, serves as an inner adjustable fastener. Advancement of this inner wing nut 31 along the threaded shaft 11 of the outer connector *7a* will tend to separate the free ends 32 of the arms 5. This action will develop a compressive force between the cross-members 6, 6a in the manner of a first class lever. Tightening the wing nuts 10 on the intermediate connectors 7 will apply a similar compressive force in the manner of a third class lever.

To reinforce the arms 5 when relatively thin metal tubing is used, wooden cores 15 may be inserted. Such cores have not been found necessary when thick walled tubes of polymer plastic are used. Protective caps 14 may also optionally be placed over the ends 32 of the arms 5. Also, the end 32a on the clamping member 2 that does not carry the wheel axle 4 may be shortened to provide improved ground clearance when the wheel assembly 13 is partially inclined.

Figure 3:
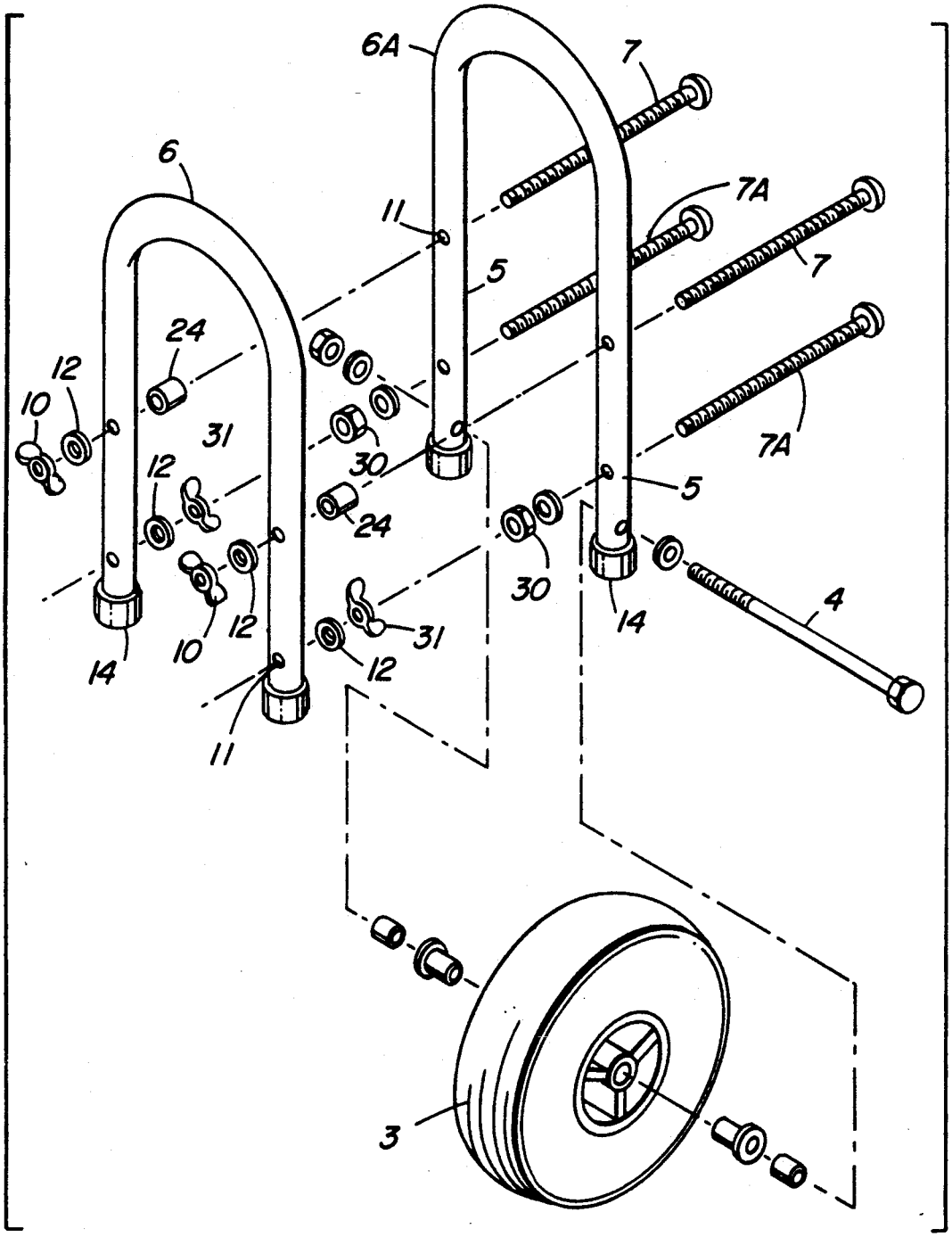
FIG. 3 is an exploded assembly drawing of the wheel assembly.

The assembly of the foregoing parts is further depicted in the exploded view of FIG. 3 wherein washers 12 are included. Also shown in FIG. 3 optional spacing sleeves 14 are included to limit the degree to which the arms 5 may be drawn together. Such sleeves will also permit the edges of heavy objects, such as the stern plate of a boat, to be slid more easily along or across the bolt 7, even when under load. They will further protect such objects from being scored by the bolt 7, which may be threaded in the portion between the arms 5.

Figure 4:
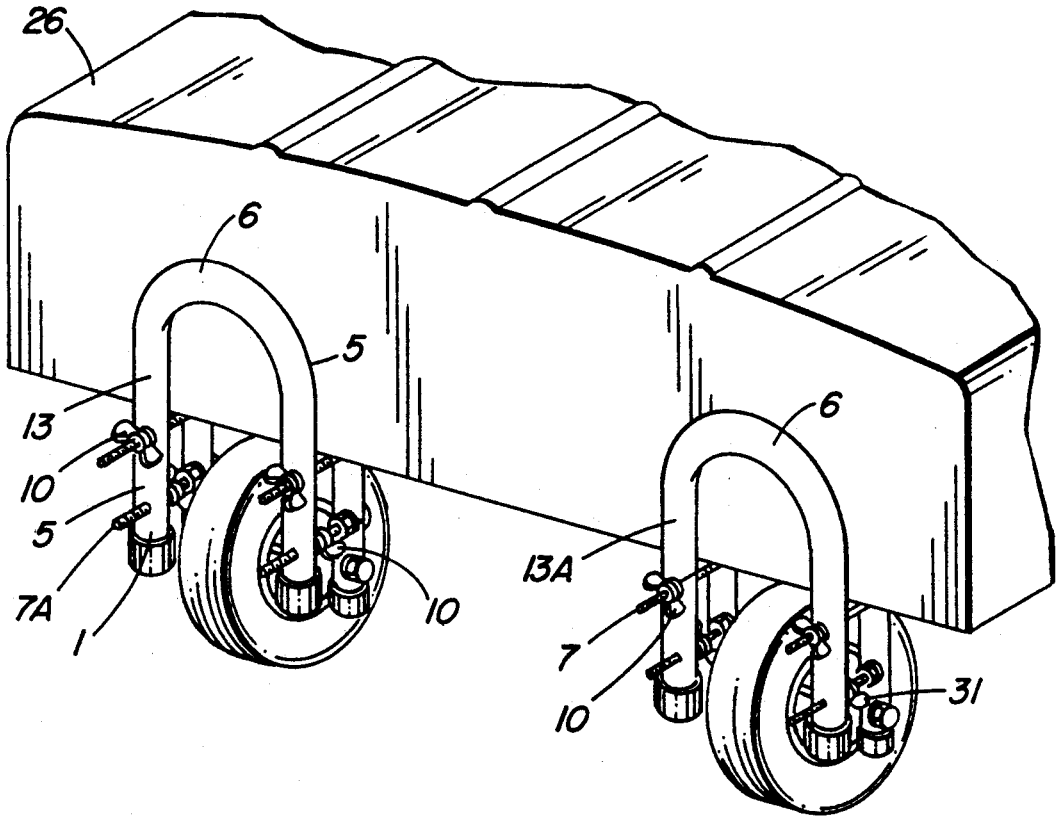
FIG. 4 is a perspective view of a pair of wheel assemblies mounted along the lower edge of a transverse panel.

In FIG. 4 a pair of wheel assemblies 13, 13a made in accordance to the invention are shown clamped to the lower edge of a piece of plywood 26. The cross member 6, 6a and arms 5 on each "U"-shaped tube 1, 2 may be drawn together in the manner of a parallel clamp by tightening the wing nuts 10. To provide the full benefit of this effect the bolts 7 should be spaced down or displaced from the cross members 6, 6a in order that the object to be clamped, plywood 26 in FIG. 4, may be placed between the cross members 6, 6a and a portion of the arms 5.

Figure 5:
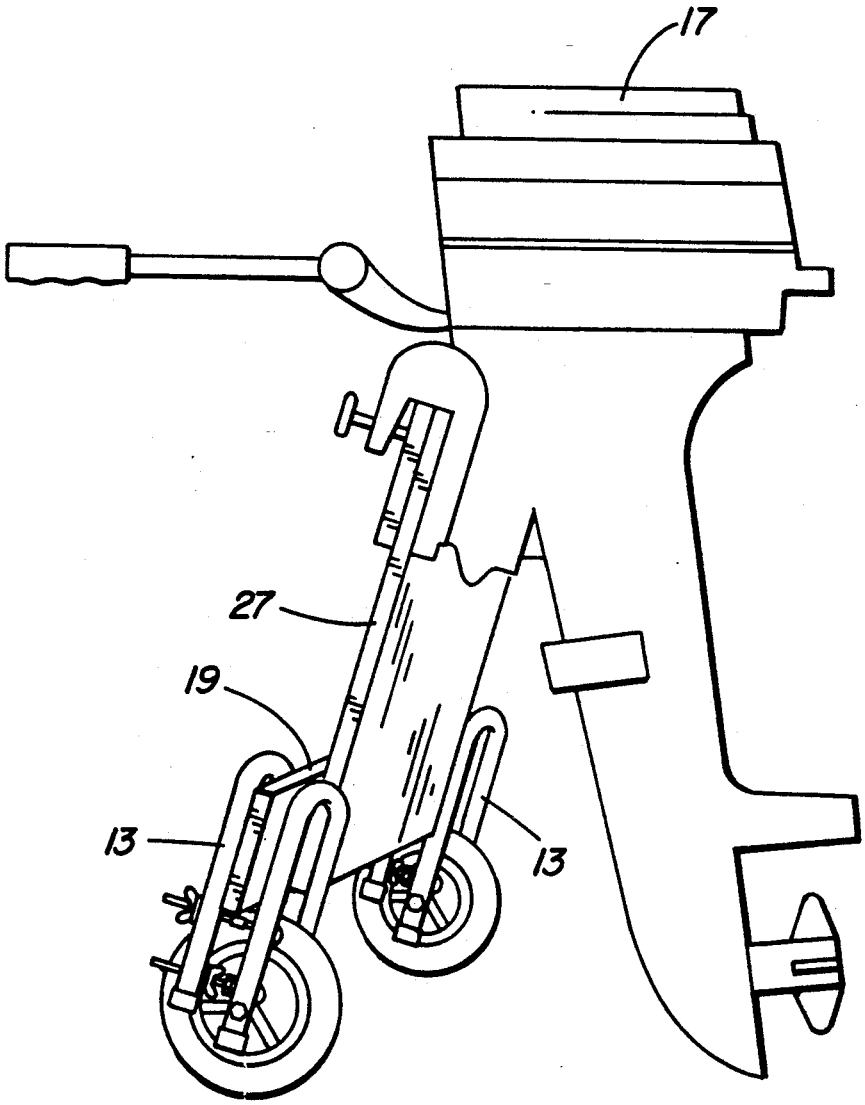
FIG. 5 is a perspective view of a motor mounted on a pair of wheel assemblies carrying an upright motor support.

In FIG. 5 a motor 17 is shown clamped to an upper plate 27 that is fastened to a transverse panel 19 that carries two wheel assemblies 13. The plate 27 and panel 19 may be detachably connected, rendering the components more compact on disassembly. Optionally, a single wheel assembly 13 may be attached directly to the plate 27, dispensing with the panel 19.

Figure 6:
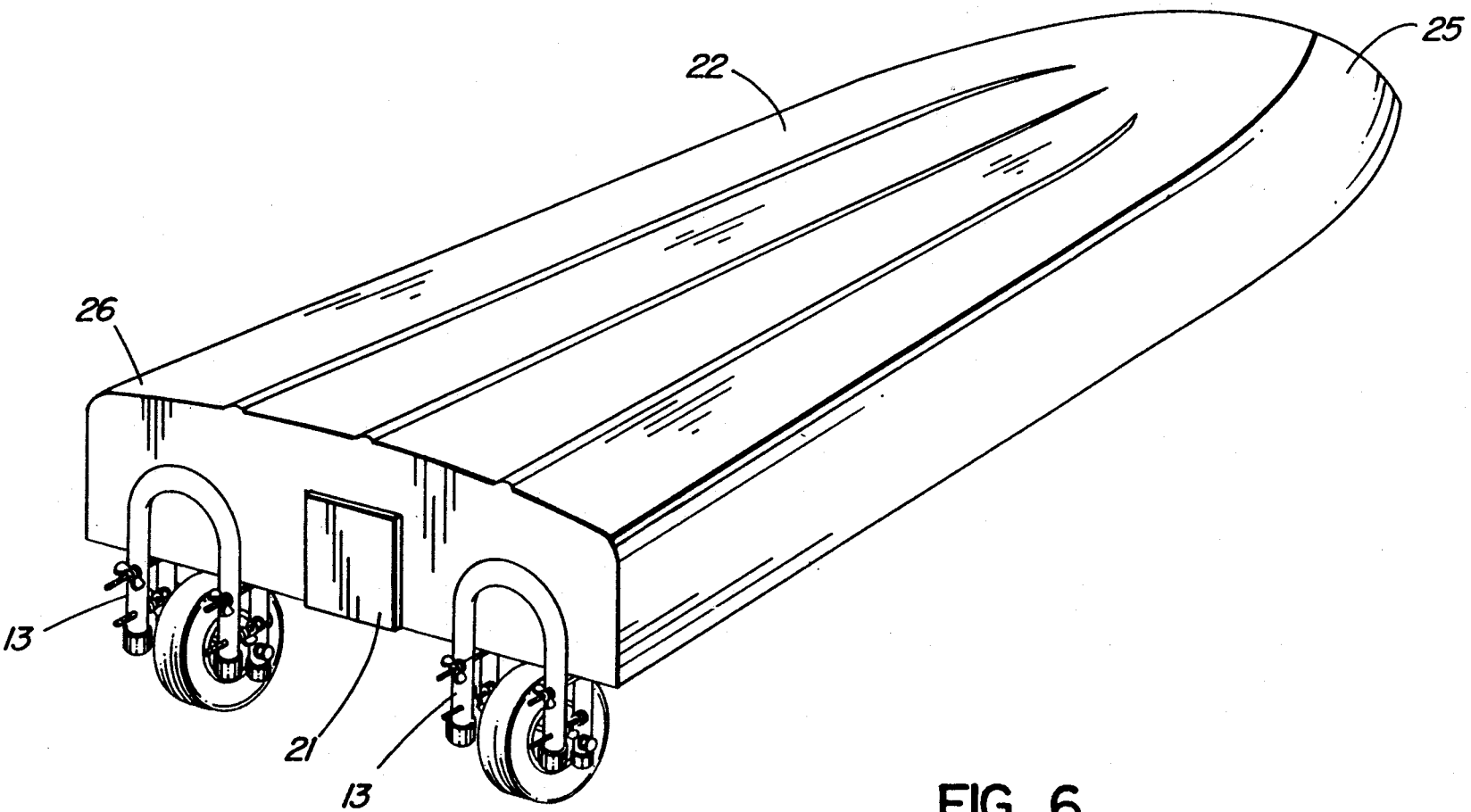
FIG. 6 is a perspective view of a pair of wheel assemblies mounted to the stem panel of a car-top boat.

In FIG. 6, a pair of wheel assemblies 13 are shown clamped to the stern transom 21 of a aluminum car-top boat 22. A single, centrally-mounted wheel assembly 20 could be utilized as an alternative, at the cost of lateral stability. In either case, a single individual is enabled by the invention to move the boat 22 to a vehicle, where he can then raise it to the roof of such vehicle by progressively lifting the bow 25, and then the stern 26.

CONCLUSION

The foregoing has constituted a description of specific embodiments showing how the invention may be applied and put into use. These embodiments are only exemplary. The invention in its broadest, and more specific, aspects is further described and defined in the claims which no follow.

The embodiments of the invention in which an exclusive right and privilege is claimed are defined as follows:

1. A wheel assembly for supporting an article for transport comprising:

(a) a wheel mounted on an axle; and (b) article attachment means carried on said axle, said attachment means having two opposed clamping members that are displaceable each towards the other, each of said clamping members having a clamping end and two outer ends spaced from each other and from said clamping end, said three ends defining for each clamping member a plane the perpendicular to which is oriented substantially perpendicularly to said axle, (c) said article attachment means incorporating adjustable linkages extending between said opposed clamping members at a locations spaced a distance from the clamping ends, said linkages being capable of drawing said clamping members together to clamp onto articles of varying dimensions to be supported by said wheel.

2. A wheel assembly as in claim 1 wherein said article attachment means is in the form of a parallel clamp.

3. A wheel assembly as in claim 1 wherein the attachment means comprises first and second opposed "U"-shaped clamping elements each having a pair of arms, the pairs of arms within each of said clamping elements being joined by a cross-member at one of their ends to form the "U"-shape and provide said clamping end to each of said clamping elements, each of said arms being provided with ends located at the opposite end from said clamping end and constituting said outer ends.

4. A wheel assembly as in claim 3 wherein:

(a) said axle extends between the two arms of said first "U"-shaped clamping element, (b) the second "U"-shaped clamping element being mounted in a substantially aligned and parallel, but adjustable, spaced relationship to said first "U"-shaped clamping element, with the arms of each of the "U"-shaped clamping elements being opposed by the arms of the other "U"-shaped clamping element.

5. A wheel assembly as in claim 4 wherein said first and second clamping elements are joined by two pairs of threaded connectors passing between the respective arms of the "U"-shaped clamping elements in a spaced array, such connectors being displaced or removed from said cross-member by a distance which will allow insertion of an article-to-be-clamped between the "U"-shaped clamping elements.

6. A wheel assembly as in claim 5 wherein of each of said pair of connectors, one connector, constituting the outer connector, is located at a position displaced or removed from the cross member, preferably near the outer end of one of said arms, and the other connector is located intermediate between the cross-member and the outer connector, thereby constituting it the intermediate connector, and wherein each of the intermediate connectors carries an adjustable arm-engaging outer fastener threaded onto such connector at a first end thereof, the other second end of each of such intermediate connectors being provided with arm-engaging outer stop means whereby the respective "U"-shaped members may be drawn together by advancing the outer fastener on the intermediate connector.

7. A wheel assembly as in claim 6 wherein the outer connector carries an arm-engaging inner stop means and an adjustable, arm-engaging inner fastener, both mounted on the outer connector at positions located between the arms of the respective "U"-shaped clamping elements so that by adjustment of the inner fastener, the arms of the respective "U"-shaped clamping members can be forced apart.

8. A wheel assembly as in claim 6 wherein the intermediate and outer connectors are fully threaded at one end into the arms of one of the "U"-shaped clamping members.

9. A wheel assembly as in claim 7 wherein the "U"-shaped members are formed from tubing, the connectors are threaded bolts with heads at one end that serve as the outer stop means, and threaded nuts are provided to serve as the inner stop means, and further wherein said adjustable fasteners are constituted by threaded nuts.

10. A wheel assembly as in claim 1, wherein the wheel assembly is mounted either singly or in pairs along the lower edge of a transverse panel, the transverse panel having an upright portion with a terminal end to which may be attached a load.

11. A wheel assembly as in claim 2, wherein the wheel assembly is mounted either singly or in pairs along the lower edge of a transverse panel, the transverse panel having an upright portion with a terminal end to which may be attached a load.

12. A wheel assembly as in claim 3, wherein the wheel assembly is mounted either singly or in pairs along the lower edge of a transverse panel, the transverse panel having an upright portion with a terminal end to which may be attached a load.

13. A wheel assembly as in claim 4, wherein the wheel assembly is mounted either singly or in pairs along the lower edge of a transverse panel, the transverse panel having an upright portion with a terminal end to which may be attached a load.

14. A wheel assembly as in claim 5, wherein the wheel assembly is mounted either singly or in pairs along the lower edge of a transverse panel, the transverse panel having an upright portion with a terminal end to which may be attached a load.

15. A wheel assembly as in claim 6, wherein the wheel assembly is mounted either singly or in pairs along the lower edge of a transverse panel, the transverse panel having an upright portion with a terminal end to which may be attached a load.

16. A wheel assembly as in claim 1 mounted in pairs on the stern panel or transom of a car-top boat for easy transportation of the boat on land.

17. A wheel assembly as in claim 2 mounted in pairs on the stern panel or transom of a car-top boat for easy transportation of the boat on land.

18. A wheel assembly as in claim 3 mounted in pairs on the stern panel or transom of a car-top boat for easy transportation of the boat on land.

19. A wheel assembly as in claim 4 mounted in pairs on the stern panel or transom of a car-top boat for easy transportation of the boat on land.

20. A wheel assembly as in claim 5 mounted in pairs on the stern panel or transom of a car-top boat for easy transportation of the boat on land.

* * * * *